United States Patent [19]

Behrmann et al.

[11] 4,303,495

[45] Dec. 1, 1981

[54] RECOVERY OF LIQUID AND GASEOUS HYDROCARBONS FROM RAW MATERIALS CONTAINING HYDROCARBONS SUCH AS OIL SHALE AND COAL

[75] Inventors: Alfred Behrmann, Erlangen; Herbert Gottschlich, Dachsbach; Christian Koch, Erlangen; Otto Abel, Clausthal-Zellerfeld, all of Fed. Rep. of Germany

[73] Assignee: Kraftwerk Union Aktiengesellschaft, Mulheim, Fed. Rep. of Germany

[21] Appl. No.: 73,529

[22] Filed: Sep. 7, 1979

[30] Foreign Application Priority Data

Sep. 18, 1978 [DE] Fed. Rep. of Germany ..... 2840575

[51] Int. Cl.[3] ..... C10G 1/00; C10J 3/68

[52] U.S. Cl. ..... 208/8 LE; 208/11 LE; 48/201; 48/197 R

[58] Field of Search ..... 208/8 LE, 11 LE; 48/201, 197 R

[56] References Cited

U.S. PATENT DOCUMENTS 4,162,964 7/1979 Leonard ..... 208/8 LE
4,250,014 2/1981 Long et al. ..... 208/8 LE
4,253,937 3/1981 Long ..... 208/8 LE

FOREIGN PATENT DOCUMENTS 2804133 2/1979 Fed. Rep. of Germany ... 208/8 LE
9730 of 1915 United Kingdom ..... 208/8 LE
285564 2/1928 United Kingdom ..... 208/8 LE

*Primary Examiner*—Delbert E. Gantz
*Assistant Examiner*—William G. Wright
*Attorney, Agent, or Firm*—Herbert L. Lerner

[57] ABSTRACT

Recovering liquid and gaseous hydrocarbons from solid raw materials containing hydrocarbons such as oil shale or coal by treating with a solvent oil at a temperature of 610° K.–690° K. and under pressure in the presence of hydrogen. The oil solvent is introduced into a heated vessel in vapor form. The raw material is introduced into the heated reaction vessel at a temperature below the condensation temperature of the oil to cause the oil vapor to condense at the surface of the raw material. The reaction vessel is heated to cause the raw material leaving the reaction vessel to be at a temperature above the condensation temperature of the oil at the pressure prevailing in the reaction vessel.

4 Claims, 1 Drawing Figure

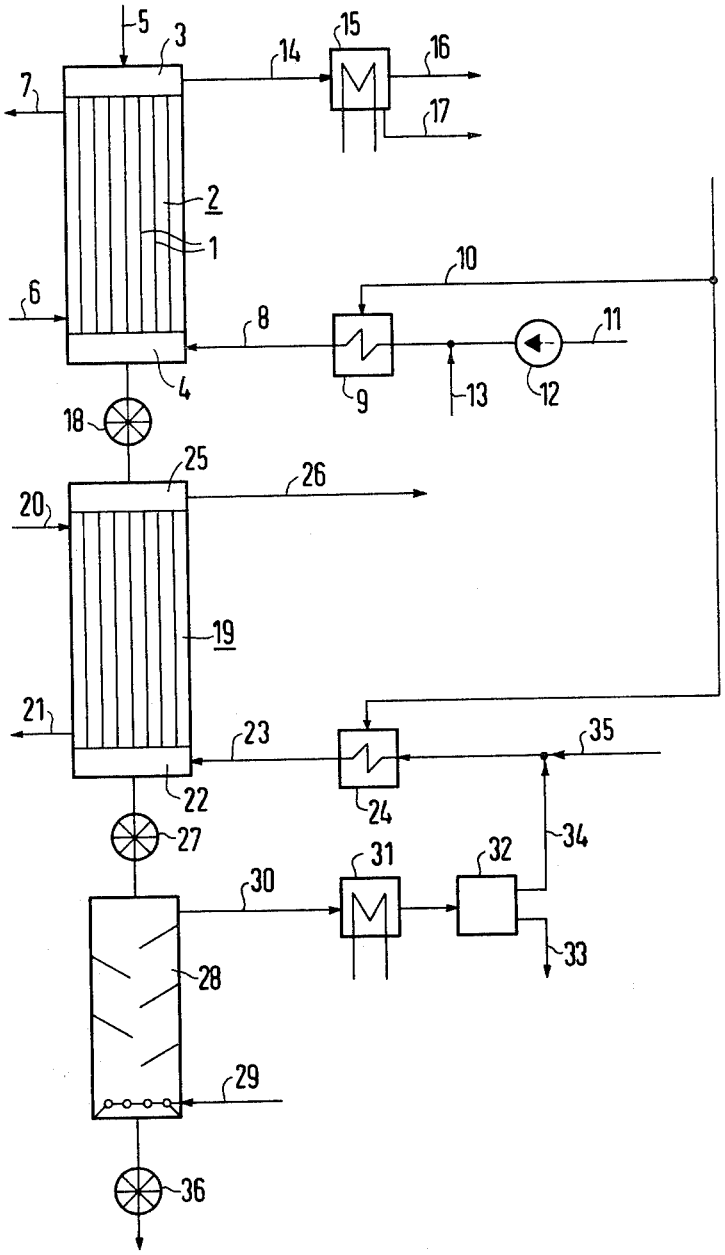
5
3
14
15
16
17
7
2
1
10
6
8
11
4
9
13
12
18
25
26
20
19
21
23
35
22
24
27
34
31
32
30
33
28
29
36

RECOVERY OF LIQUID AND GASEOUS HYDROCARBONS FROM RAW MATERIALS CONTAINING HYDROCARBONS SUCH AS OIL SHALE AND COAL

BACKGROUND OF THE INVENTION

1. Field of the Invention

The invention relates to a method for recovering liquid and gaseous hydrocarbons from solid raw fossil materials containing hydrocarbons such as oil shale or coal.

2. Description of the Prior Art

In German Published Non-Prosecuted Application No. 28 04 133, is described a method wherein oil is added to the raw material at a temperature of 610 to 690 K and a pressure of 20 to 100 bar and wherein, after a certain reaction time, the substances then dissolvable from the raw material are separated in subsequent process stages from the remaining residues by means of solvents such as gasoline.

SUMMARY OF THE INVENTION

An object of the present invention to provide an improved method to more efficiently extract the hydrocarbons in the raw material.

With the foregoing and other objects in view, there is provided in accordance with the invention a method for recovering liquid and gaseous hydrocarbons from comminuted raw solid fossil materials containing hydrocarbons such as oil shale and coal by adding oil to the raw material at a temperature of 610 K to 690 K and a pressure of 20 to 100 bar for a sufficient length of time to effect conversion of hydrocarbons in the raw material to gases and normally liquid hydrocarbons and a solid residue, and separating the normally liquid hydrocarbons from the solid residue by solvent extraction with a volatile liquid solvent, the improvement comprising introducing said added oil in a vaporous state into a heated reaction vessel, introducing said raw material into the heated reaction vessel at a temperature below the condensation temperature of the oil to cause said oil vapor to condense at the surface of said raw material, passing the raw material through the reaction vessel and heating said reaction vessel to cause said raw material leaving said reaction vessel to be at a temperature above the condensation temperature of said oil at the pressure prevailing in the reaction vessel.

Other features which are considered as characteristic for the invention are set forth in the appended claims.

Although the invention is illustrated and described herein as embodied in the recovery of liquid and gaseous hydrocarbons from raw materials containing hydrocarbons such as oil shale and coal, it is nevertheless not intended to be limited to the details shown, since various modifications may be made therein without departing from the spirit of the invention and within the scope and range of equivalents of the claims.

BRIEF DESCRIPTION OF THE DRAWING

The invention, however, together with additional objects and advantages thereof will be best understood from the following description when read in connection with the accompanying drawing, in which is diagrammatically illustrated one method for carrying out the operation in accordance with the present invention.

DETAILED DESCRIPTION OF THE INVENTION

According to the invention, the oil in vaporous condition flows into a heated reaction vessel. The raw material is placed in the reaction vessel at a temperature below the condensation temperature of the oil. The heating of the reaction vessel is set so that the temperature of the raw material leaving the reaction vessel is above the condensation temperature of the oil at the pressure prevailing in the reaction vessel.

The removal of hydrocarbons from solid fossil materials containing the same may be accomplished by treating with an oil which acts as a solvent but may also be a reactant for the transfer of hydrogen, at a high temperature to decompose the hydrocarbons in the raw material to normally liquid hydrocarbons having a wide boiling range and normally gaseous hydrocarbons. For example, kerogen is the resinous chief organic constituent of shale oils. At 400° C., it yields fuel oil and gas.

The removal of hydrocarbons from the solid materials is preferably carried out in the presence of hydrogen. The oil employed for contact with the solid materials may be gas oil or a similar distillate fraction boiling within the range of about 200°–400° C.

An embodiment example will be described in the following with reference to the schematic drawing.

A reaction vessel 2 containing individual tubes 1 has an upper chamber 3 and a lower chamber 4. The raw material, milled oil shale or milled coal with a grain size about 4 mm, is fed-in through feed line 5 in an amount of, for instance, 10 kg/sec. into the upper chamber 3. The raw material enters the tubes 1 from the upper chamber 3.

A hot gas, which may be any suitable heated gas such as combustion gas, enters a hot gas line 6 at a point near the outlet of tubes 1, flows outside the tubes 1 for heating the reaction vessel 2 and leaves the reaction vessel via a hot gas line 7 near the inlet of tubes 1.

A solvent oil is fed through line 8 into the lower chamber 4. A heat exchanger 9 is inserted into this solvent line 8, to heat the solvent. Steam enters the heat exchanger 9 through steam line 10, to heat the solvent oil introduced through oil line 11, at the rate of about 1 kg/second of the oil (for instance $C_{12}H_{26}$). Pump 12 in the oil line 11 forces the oil at a pressure of about 35 bar, through heat exchanger 9 into lower chamber 4. In addition, a quantity of 20 l/s hydrogen at this pressure is added to the oil via hydrogen line 13.

The pressure in the reaction vessel 2 is chosen so that the mixture of oil and hydrogen, flows into the lower chamber 4 of the reaction vessel 2 in the vaporous state at a temperature of about 670 K. When the solvent and the raw material come together, part of the solvent will condense at the surface of the raw material and will thereby initiate the conversion process of the organic material (kerogen) contained in the raw material.

However, the raw material is heated up by heating it by means of the hot gas entering line 6 and leaving line 7, so that the liquid zone travels farther into the interior of the raw material particles. Furthermore, the raw material, near its point of discharge from the reaction vessel is heated to a temperature which is above the condensation temperature of the solvent. A large part of the solvent will therefore evaporate together with part of the hydrocarbons extracted from the raw material and can leave the reaction vessel 2 through outlet line 14.

A cooler 15 is inserted into the discharge line 14, wherein the hydrogen and the gaseous hydrocarbons are separated from the liquid hydrocarbons. In the present embodiment example, about 10 l/s hydrogen and 2 l/s gaseous hydrocarbons are released through the line 16. 0.9 kg/s gas oil and 1 kg/s extracted oil leave the plant through line 17 which is connected, like line 16, to the cooler 15.

The thus pre-treated and partially extracted raw material moves from the reaction vessel 2 via a known pressure lock 18 into a second reaction vessel 19 of similar design. This reaction vessel is cooled by cooling gas entering line 20 and discharging through line 21. A highly volatile solvent, for instance, 3 kg/s gasoline in vapor form is added at a temperature of 390 K to the lower chamber 22 of the reaction vessel 19.

The gasoline solvent is heated in a steam-heated heat exchanger 24 and the heated gasoline introduced through line 23 into chamber 22. From the upper chamber 25 of the reaction vessel 19, a mixture of 2.7 kg/s gasoline, 0.1 kg/s oil and 1.5 kg/s extract dissolved from the raw material is drawn off via a line 26. The remaining raw material passes via a pressure lock 27 either to the outside for further treatment or, for complete recovery of the solvent, into an extraction vessel 28, to which 1.5 kg/s low-pressure steam is fed via line 29. The steam together with the remaining dissolved solvent is discharged from the extraction vessel 28 through line 30. A cooler 31 and a separating device 32 are inserted into the line 30, for condensing the steam contained in the solvent and separating the water from the solvent.

A quantity of 1 kg/s condensed water flows through the condensate line 33. The solvent leaves the separator 32 through solvent line 34. The solvent line 34 is connected to the heat exchanger 24 for reusing the gasoline as the solvent.

Any additionally required amount of solvent is fed into the heat exchanger 24 through a line 35. Following the extraction vessel 28, the residual material leaves the extraction vessel 28 via a further pressure lock 36.

If carbon is used as raw material, a carbon largely free of hydrocarbons is obtained. This carbon however, can be used for heating purposes, for instance, in a connected coal power plant.

There are claimed:

1. Method for recovering liquid and gaseous hydrocarbons from comminuted raw solid fossil materials containing hydrocarbons such as oil shale and coal by adding oil to the raw material at a temperature of 610 K to 690 K and a pressure of 20 to 100 bar for a sufficient length of time to effect conversion of hydrocarbons in the raw material to gases and normally liquid hydrocarbons and a solid residue, and separating the normally liquid hydrocarbons from the solid residue by solvent extraction with a volatile liquid solvent, the improvement comprising introducing said added oil in a vaporous state into a heated reaction vessel, introducing said raw material into the heated reaction vessel at a temperature below the condensation temperature of the oil to cause said oil vapor to condense at the surface of said raw material, passing the raw material through the reaction vessel and heating said reaction vessel to cause said raw material leaving said reaction vessel to be at a temperature above the condensation temperature of said oil at the pressure prevailing in the reaction vessel.

2. Method according to claim 1, wherein the raw material is introduced into an upper chamber, thence through a plurality of heated parallel individual tubes, and thence discharges into a lower chamber.

3. Method according to claim 1, wherein said raw material is additionally subjected to the presence of hydrogen gas in said oil vapor in said reaction zone.

4. Method according to claim 2, wherein the parallel individual tubes are heated by passing hot gas over the outside surface of the tubes containing the raw material, and wherein the hot gas at its highest temperature is first passed over the outside surface of the tubes at a point near the discharge of the raw material into the lower chamber to cause the raw material leaving the reaction vessel to be at a temperature above the condensation temperature of said oil vapor.

* * * * *